US007921484B2

(12) United States Patent
Bendele et al.

(10) Patent No.: US 7,921,484 B2
(45) Date of Patent: Apr. 12, 2011

(54) PATIENT REPOSITIONING AND LIMB MANAGEMENT SYSTEM

(75) Inventors: Kevin Bendele, Adkins, TX (US); Richard Kazala, San Antonio, TX (US)

(73) Assignee: KCI Licensing, Inc., San Antonio, TX (US)

( * ) Notice: Subject to any disclaimer, the term of this patent is extended or adjusted under 35 U.S.C. 154(b) by 231 days.

(21) Appl. No.: 12/021,876

(22) Filed: Jan. 29, 2008

(65) Prior Publication Data

US 2008/0201843 A1 Aug. 28, 2008

Related U.S. Application Data

(60) Provisional application No. 60/888,824, filed on Feb. 8, 2007.

(51) Int. Cl.
*A61G 7/10* (2006.01)

(52) U.S. Cl. ..... 5/83.1; 5/81.1 R; 5/85.1

(58) Field of Classification Search ..... 5/81.1 R, 5/85.1, 83.1; 482/69
See application file for complete search history.

(56) References Cited

U.S. PATENT DOCUMENTS

| | | | | |
|---|---|---|---|---|
| 2,272,778 | A * | 2/1942 | Reuter | 5/85.1 |
| 3,006,485 | A * | 10/1961 | Martin | 414/542 |
| 3,490,385 | A * | 1/1970 | Wallace et al. | 104/126 |
| 4,296,509 | A * | 10/1981 | Simmons et al. | 5/85.1 |
| 4,627,119 | A * | 12/1986 | Hachey et al. | 5/85.1 |
| 5,158,188 | A | 10/1992 | Nordberg | 212/312 |
| 5,327,592 | A | 7/1994 | Stump | |
| 5,337,908 | A | 8/1994 | Beck, Jr. | |
| 5,539,941 | A * | 7/1996 | Fuller | 5/85.1 |
| 5,560,054 | A | 10/1996 | Simon | |
| 6,006,377 | A * | 12/1999 | Asakawa | 5/83.1 |
| 6,568,003 | B1 | 5/2003 | Vest | |
| 6,637,610 | B1 * | 10/2003 | Cheeseboro | 212/327 |
| 6,907,625 | B2 | 6/2005 | Nomura | 5/81.1 HS |
| 7,237,491 | B2 * | 7/2007 | Faucher et al. | 104/89 |
| 7,462,138 | B2 * | 12/2008 | Shetty et al. | 482/69 |
| 2007/0240260 | A1 * | 10/2007 | White et al. | 5/81.1 R |

FOREIGN PATENT DOCUMENTS

| | | |
|---|---|---|
| DE | 806 989 | 6/1951 |
| GB | 2 275 607 | 9/1994 |
| WO | WO 92/00052 | 1/1992 |

OTHER PUBLICATIONS

Supplementary European Search Report, issued in European application No. EP 08 72 8509, dated Apr. 22, 2010.

* cited by examiner

*Primary Examiner* — Robert G Santos
*Assistant Examiner* — Brittany M Wilson

(57) ABSTRACT

A system for repositioning a patient. The system may be coupled to a structural support system or framework that extends above a bed. The system may be translated transversely and longitudinally and placed in one of multiple locations above the bed.

19 Claims, 16 Drawing Sheets

FIG. 3

PATIENT REPOSITIONING AND LIMB MANAGEMENT SYSTEM

CROSS-REFERENCE TO RELATED APPLICATIONS

This application claims the priority of U.S. Provisional Patent Application Ser. No. 60/888,824, filed Feb. 8, 2007, the entire disclosure of which is specifically incorporated herein by reference.

FIELD OF THE INVENTION

The present disclosure relates generally to apparatus, methods, and systems used to reposition a patient or a part of a patient, such as the patient's limb.

BACKGROUND

Patients and other persons restricted to bed for extended periods often require assistance in being repositioned within a bed or transferred from one bed to another bed or support surface. Depending on the type of repositioning being performed, a caregiver may need to employ a device such as a lifting sling or a repositioning or roll sheet. A lifting sling may be used when a person (or a part of the person, such as a limb) is being lifted out of bed with an overhead lifting device, while a repositioning sheet may be used to reposition or roll a person within a bed.

In certain existing systems, a portable lifting hoist must be located and transported to the patient to assist in the repositioning of the patient or aid in moving a limb of the patient. This may take considerable time on the part of the caregiver. In other existing systems, a hoist may be attached to a permanent overhead system, such as a track in the ceiling, to reposition the patient. Such systems require considerable expense to install and are not portable to other locations or beds. In addition, patients sometimes need assistance from a caregiver with ingress or egress from a bed. However, if an overhead support or handle were available, the patient may be able to get into or out of the bed without the assistance of a caregiver. Because a hoist may be difficult to locate or not available, a caregiver may be required to lift a patient or a portion of the patient without the assistance of a hoist. Such actions can lead to strain on the caregiver and possible injury.

It is therefore desirable to provide a patient repositioning and limb management system that addresses these shortcomings found in existing devices.

SUMMARY

Exemplary embodiments of the present disclosure comprise systems for repositioning a person. In specific exemplary embodiments, the system may comprise a first transverse support member and a second transverse support member coupled to the first transverse support member, where the second transverse support member is configured to translate with respect to the first transverse support member. Exemplary embodiments may also comprise a first longitudinal member coupled to a first end of the first transverse support member, and a second longitudinal member coupled to a second end of the second transverse support member. In certain exemplary embodiments, the first and second longitudinal members are configured for engagement with a bed framework comprising a first and a second longitudinal support member.

In specific exemplary embodiments, a first end of the second transverse support member is configured to extend beyond the first longitudinal member when the system is in a first position, and a second end of the second transverse support member is configured to extend beyond the second longitudinal member when the system is in a second position.

Certain exemplary embodiments may also comprise a first locking member configured to secure the second transverse support member so that the second transverse support member is restricted from translating with respect to the first transverse support member. Exemplary embodiments may further comprise a second locking member configured to secure the first or second longitudinal member so that the first and second longitudinal members are restricted from moving with respect to the first and second longitudinal support members during use. Other exemplary embodiments may also comprise a structural support system that extends above a bed or other support surface comprising a head-end, a foot-end, a right side and a left side. In certain exemplary embodiments, the system is configured to be positioned in one of multiple locations between the head-end, the foot-end, the right side, and the left side.

Exemplary embodiments may further comprise a handle and/or a hoist coupled to either the first or second transverse support members. In certain exemplary embodiments, a sling may be coupled to the hoist. A repositioning sheet may also be coupled to the hoist via a spreader bar in certain exemplary embodiments.

In exemplary embodiments, the first and second transverse support members are comprised of at least one of powder-coated steel, powder-coated aluminum, and hard anodized aluminum. The first and second longitudinal members may each comprise a low friction insert in exemplary embodiments.

Exemplary embodiments may further comprise a first slide member, where the first slide member is coupled to the first transverse support member in a translational engagement and the first slide member is coupled to the second transverse support member in a non-translational engagement. Other exemplary embodiments may further comprise a second slide member coupled to the second transverse support member in a translational engagement. Exemplary embodiments may further comprise a coupling member coupling the first slide member to the second transverse support member, where the second slide member is configured to translate past the coupling member.

Exemplary embodiments may also comprise a bed, and a framework coupled to the bed and extending above the bed, where the framework comprises a first longitudinal support member and a second longitudinal support member. Exemplary embodiments may also comprise a transverse support member comprising a first end and a second end, a first longitudinal member coupled to the first end of the first transverse support member, and a second longitudinal member coupled to the second end of the second transverse support member. Exemplary embodiments may also comprise a lifting apparatus coupled to the transverse support member, where the lifting apparatus is configured to be moved between the first end and the second end of the transverse support member. In certain exemplary embodiments, the lifting apparatus is a hoist. In certain exemplary embodiments, the hoist may be an electric hoist or a mechanical hoist. In certain exemplary embodiments, the lifting apparatus may comprise a rolling element that engages the transverse support member.

Exemplary embodiments may also comprise a bed and a framework coupled to the bed and extending above the bed, where the framework comprises a first longitudinal support member, a second longitudinal support member, a head-end transverse member and a foot-end transverse member. Exemplary embodiments may also comprise a lifting apparatus coupled to the framework, where the lifting apparatus is configured to be moved between the head-end transverse member, the first longitudinal support member, the foot-end transverse member, the second longitudinal support member, and back to the head-end transverse member without being decoupled from the framework. In exemplary embodiment, the framework may further comprise a plurality of curved portions between the head-end transverse member, the first longitudinal support member, the foot-end transverse member, and the second longitudinal support member.

BRIEF DESCRIPTION OF THE DRAWINGS

While exemplary embodiments of the present invention have been shown and described in detail below, it will be clear to the person skilled in the art that changes and modifications may be made without departing from the scope of the invention. As such, that which is set forth in the following description and accompanying drawings is offered by way of illustration only and not as a limitation. The actual scope of the invention is intended to be defined by the following claims, along with the full range of equivalents to which such claims are entitled.

In addition, one of ordinary skill in the art will appreciate upon reading and understanding this disclosure that other variations for the invention described herein can be included within the scope of the present invention. For example, different materials of construction may be used for the components in the limb management and patient repositioning system. Furthermore, the shape of individual components may also be altered.

Figure 1:
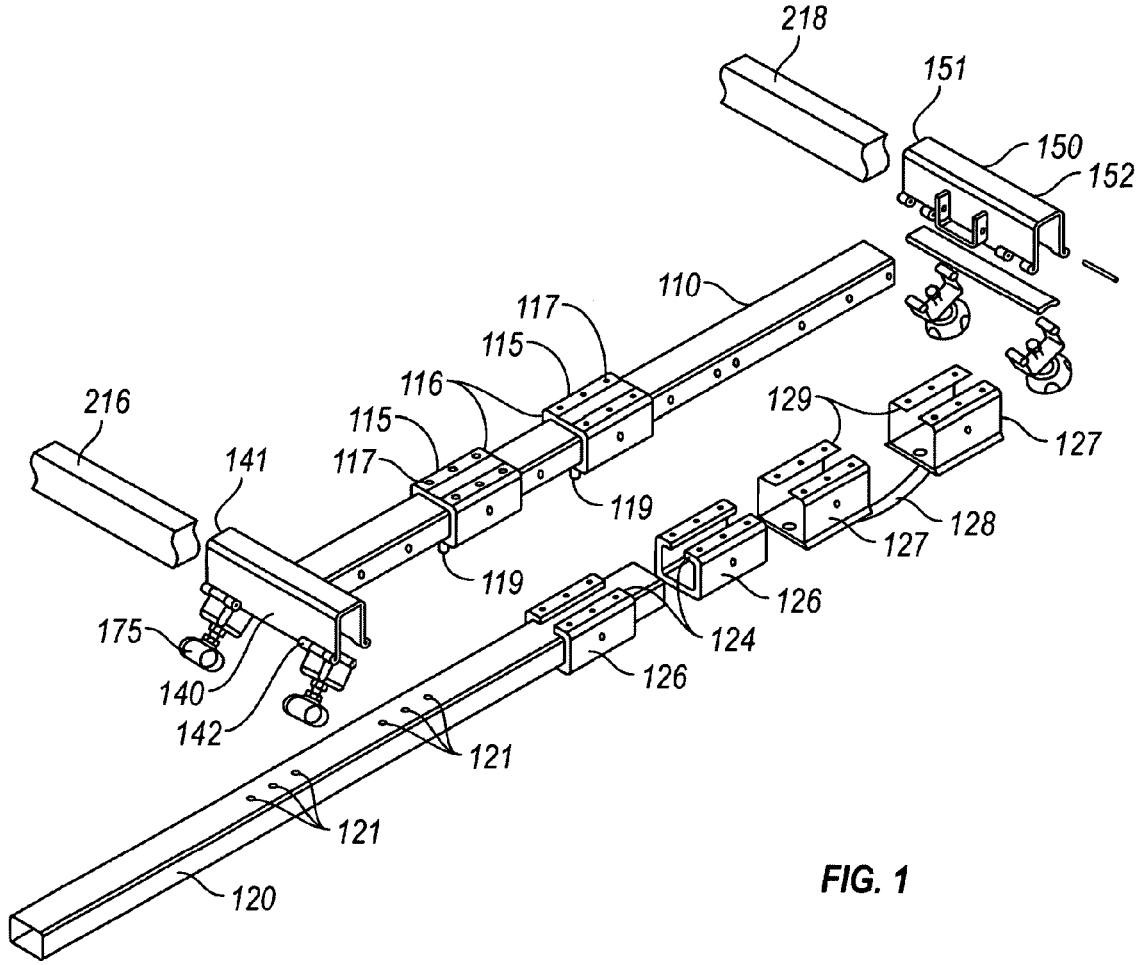

In the following Detailed Description of Exemplary Embodiments, various features are grouped together in several embodiments for the purpose of streamlining the disclosure. This method of disclosure is not to be interpreted as reflecting an intention that exemplary embodiments of the invention require more features than are expressly recited in each claim. Rather, as the following claims reflect, inventive subject matter lies in less than all features of a single disclosed embodiment. Thus, the following claims are hereby incorporated into the Detailed Description of Exemplary Embodiments, with each claim standing on its own as a separate embodiment.

Figure 2:
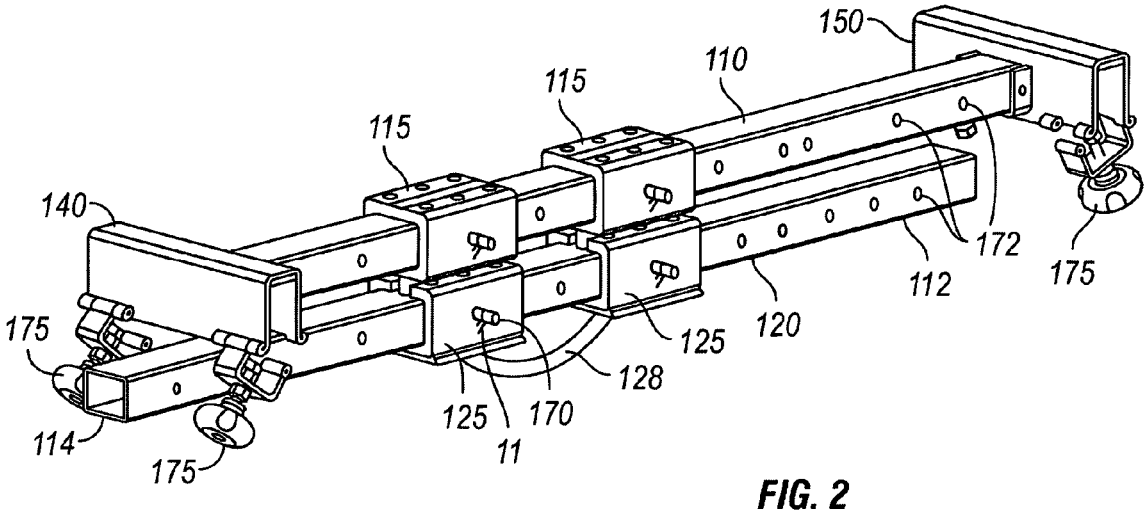
Figure 3:
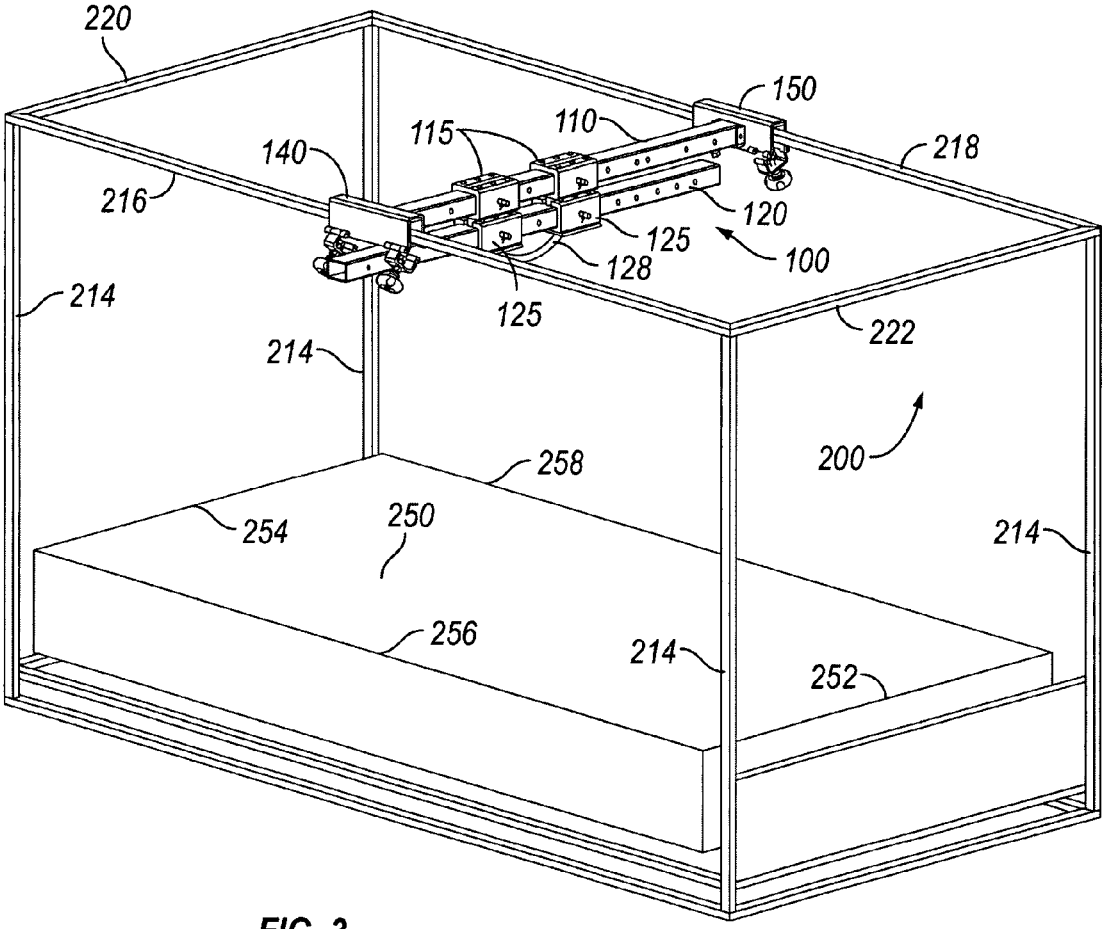
Figure 4:
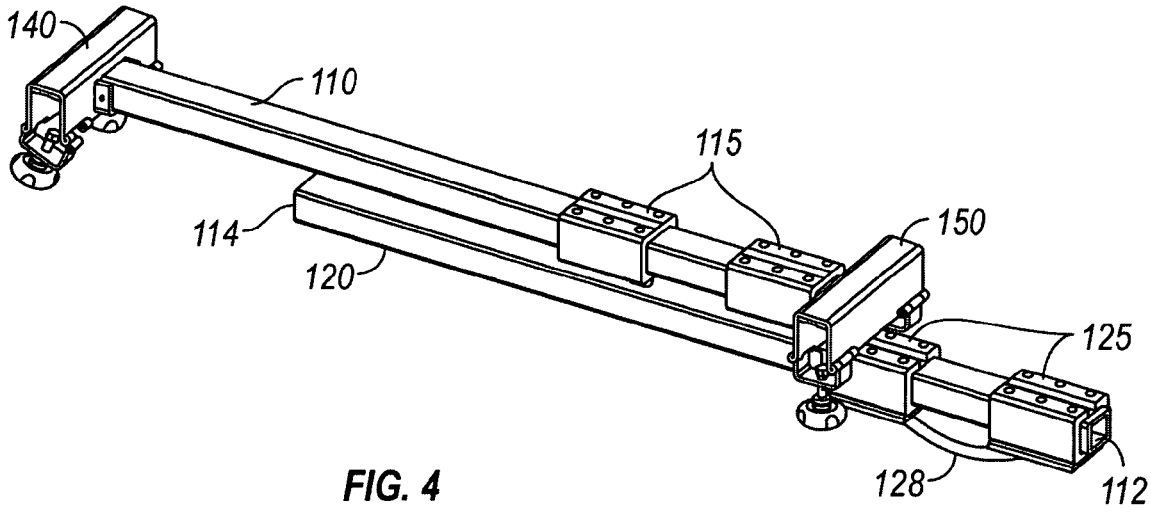
Figure 5:
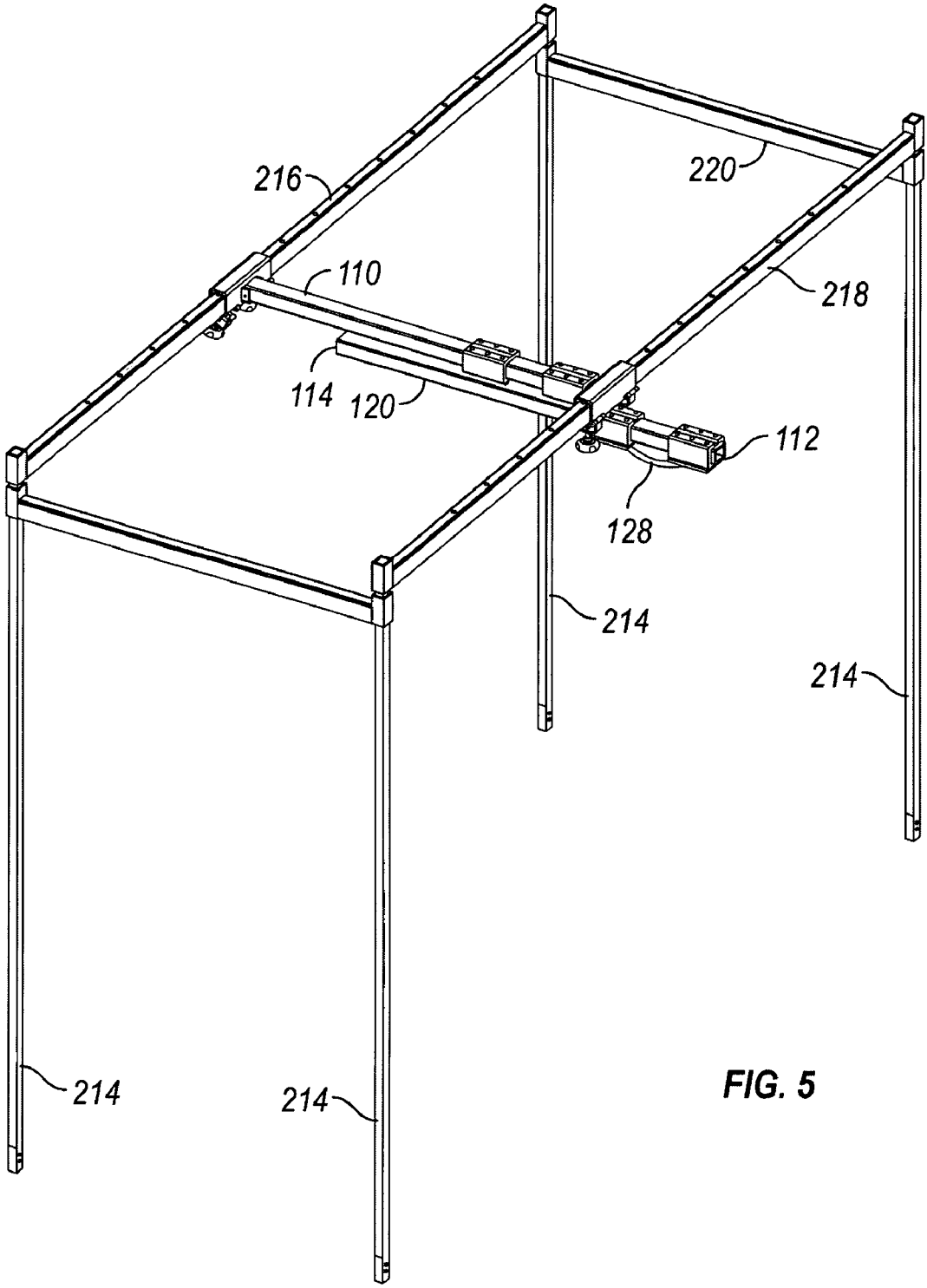
Figure 6:
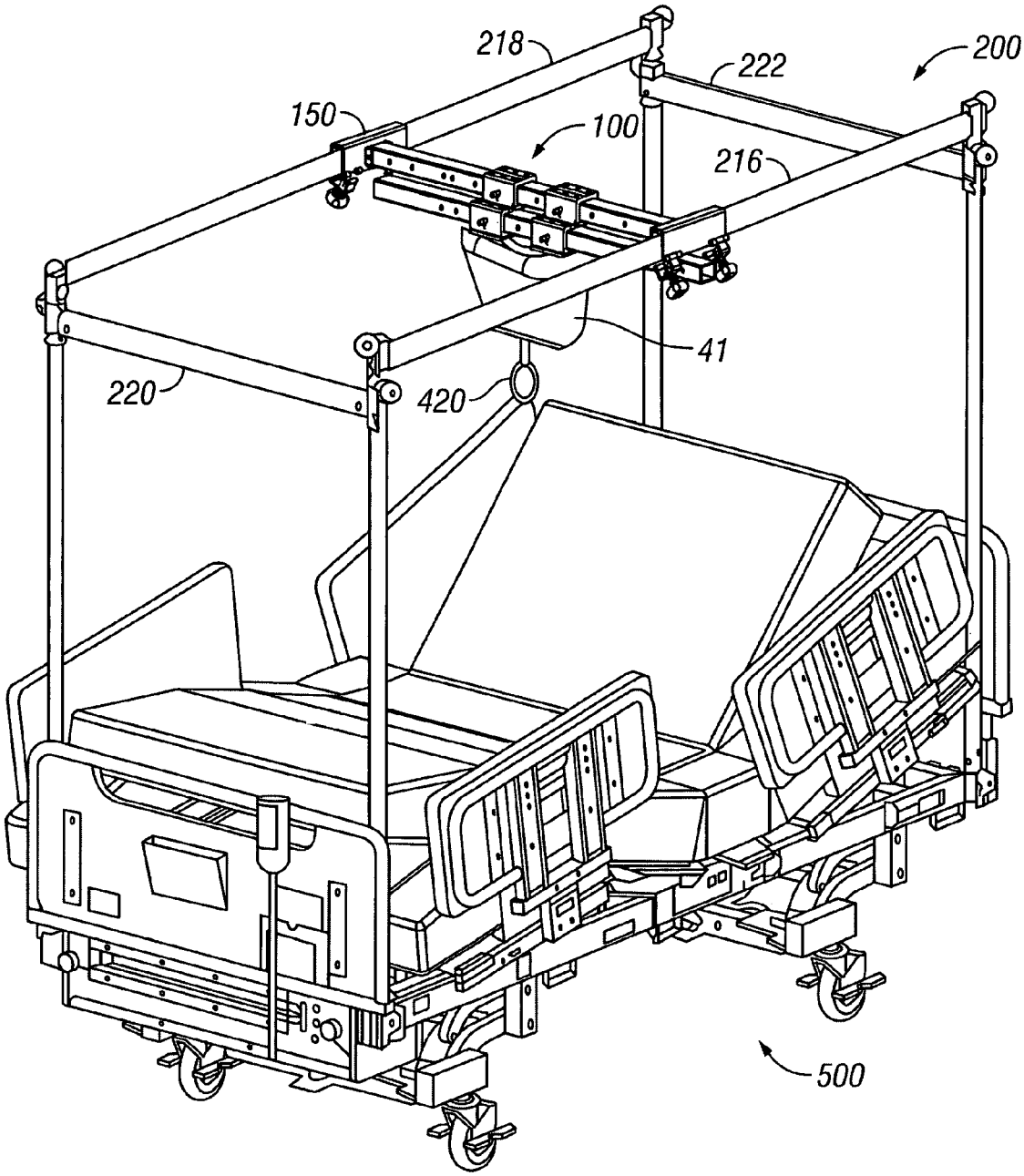
Figure 7:
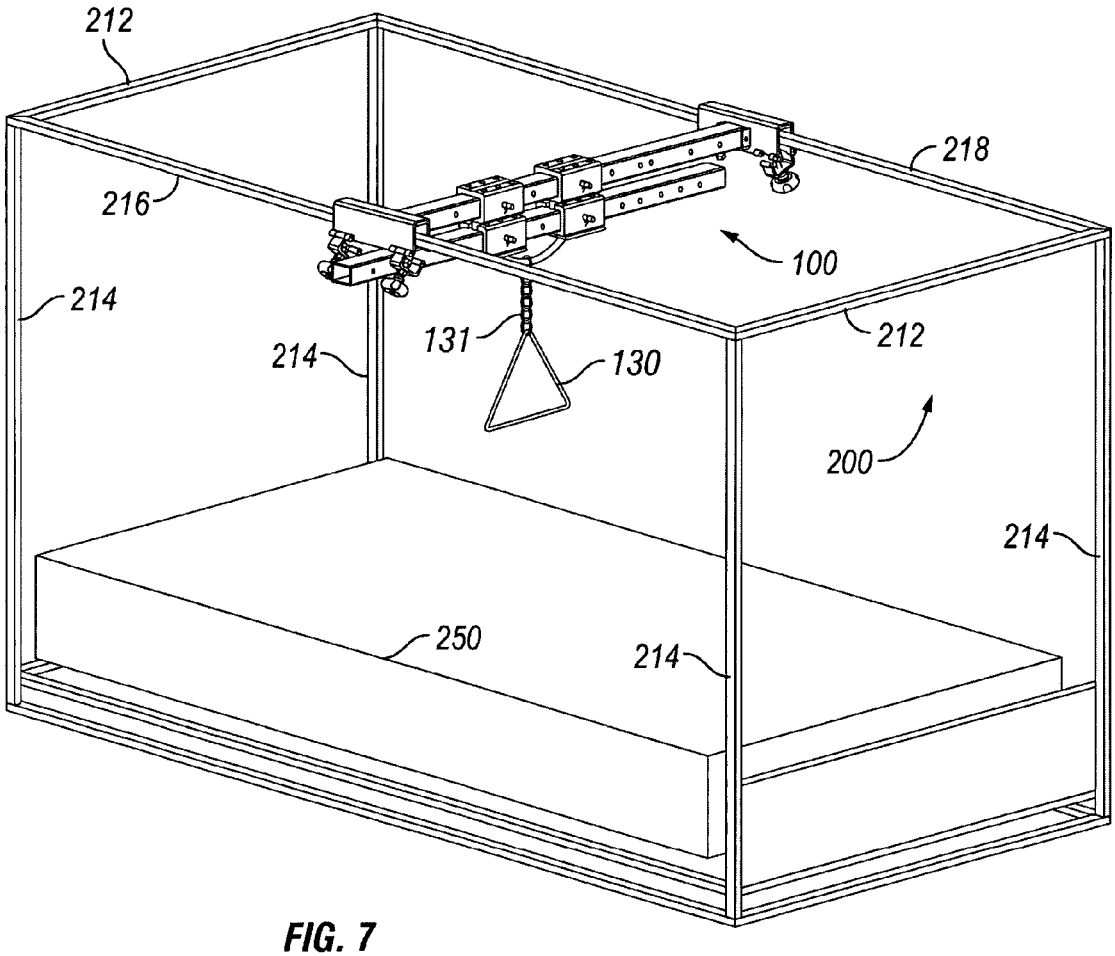
Figure 8:
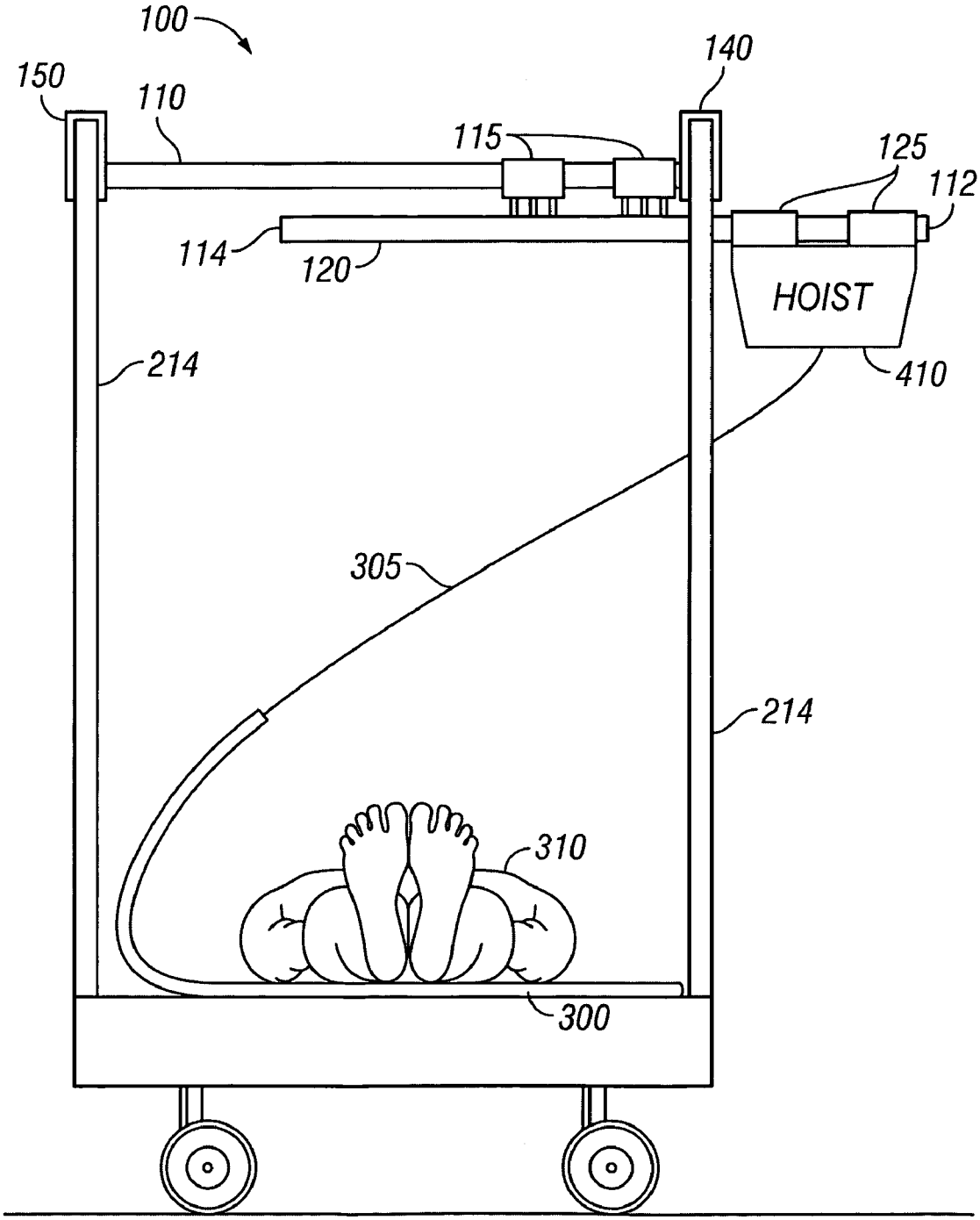
Figure 9:
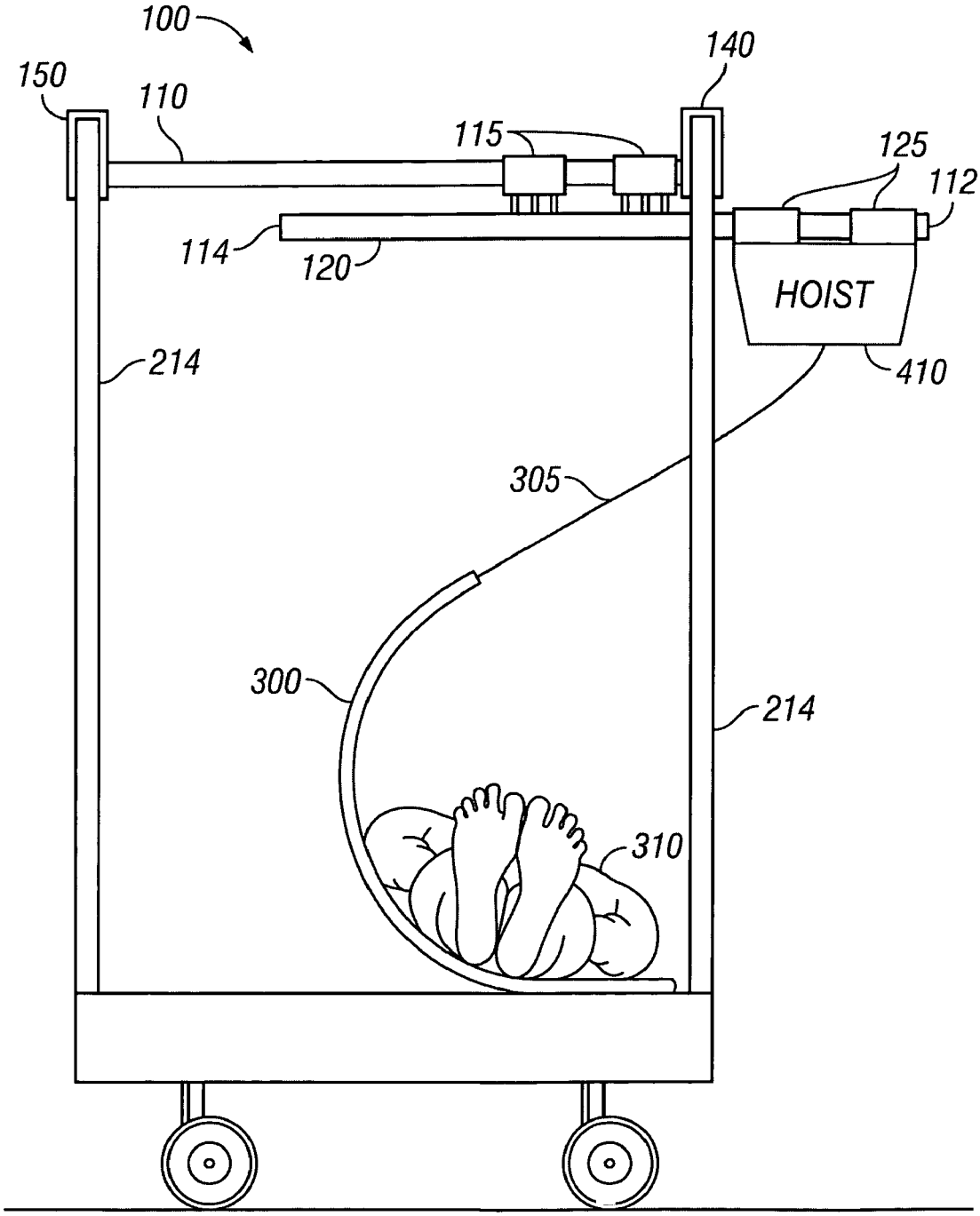
Figure 10:
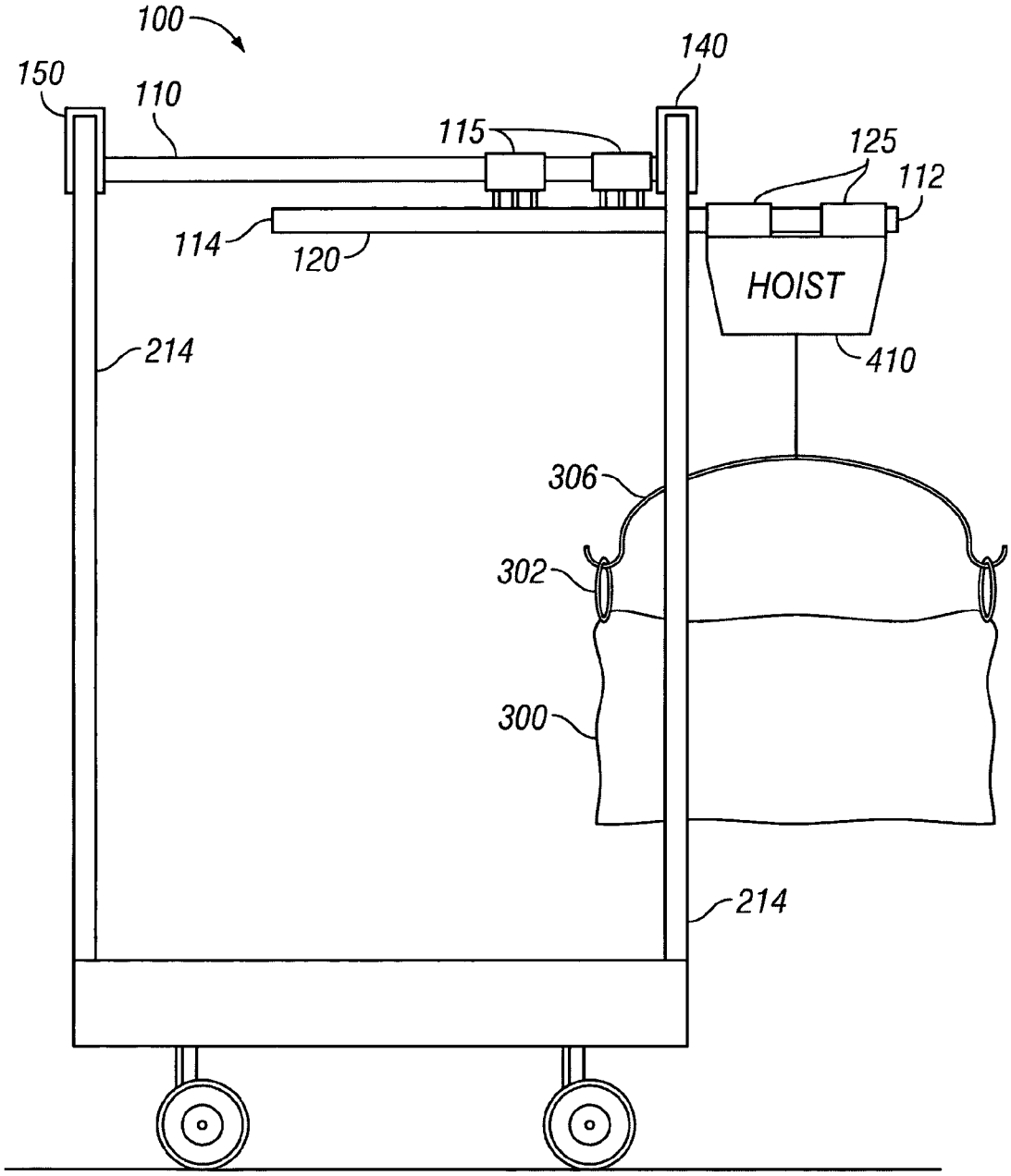
Figure 11:
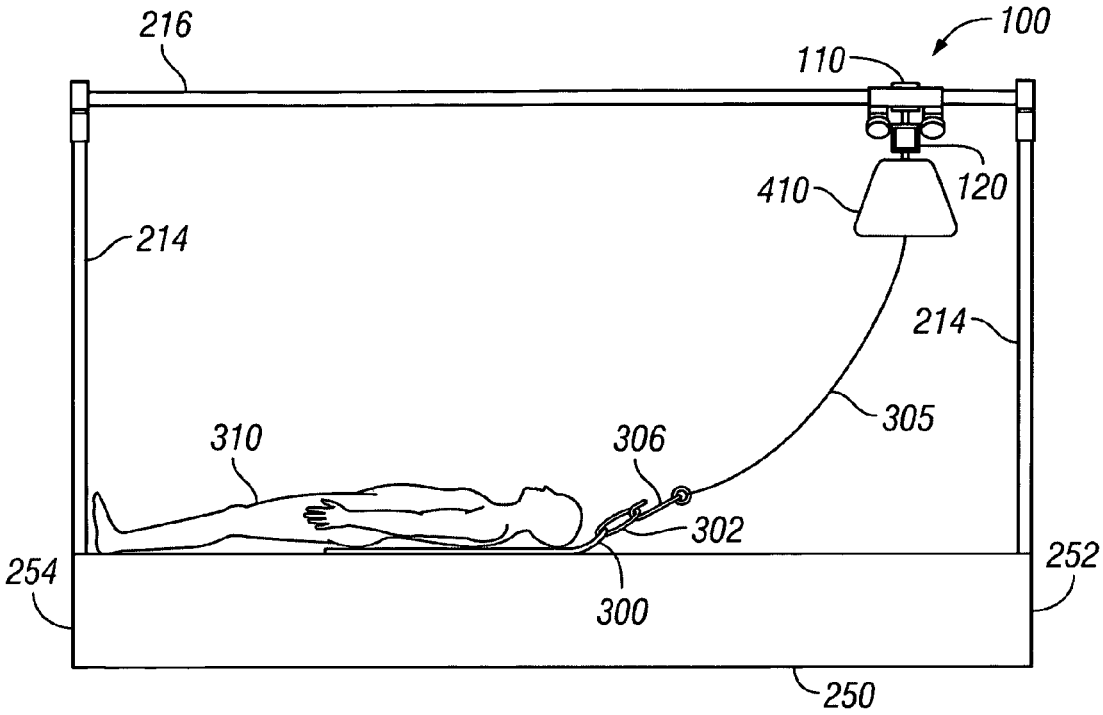
Figure 12:
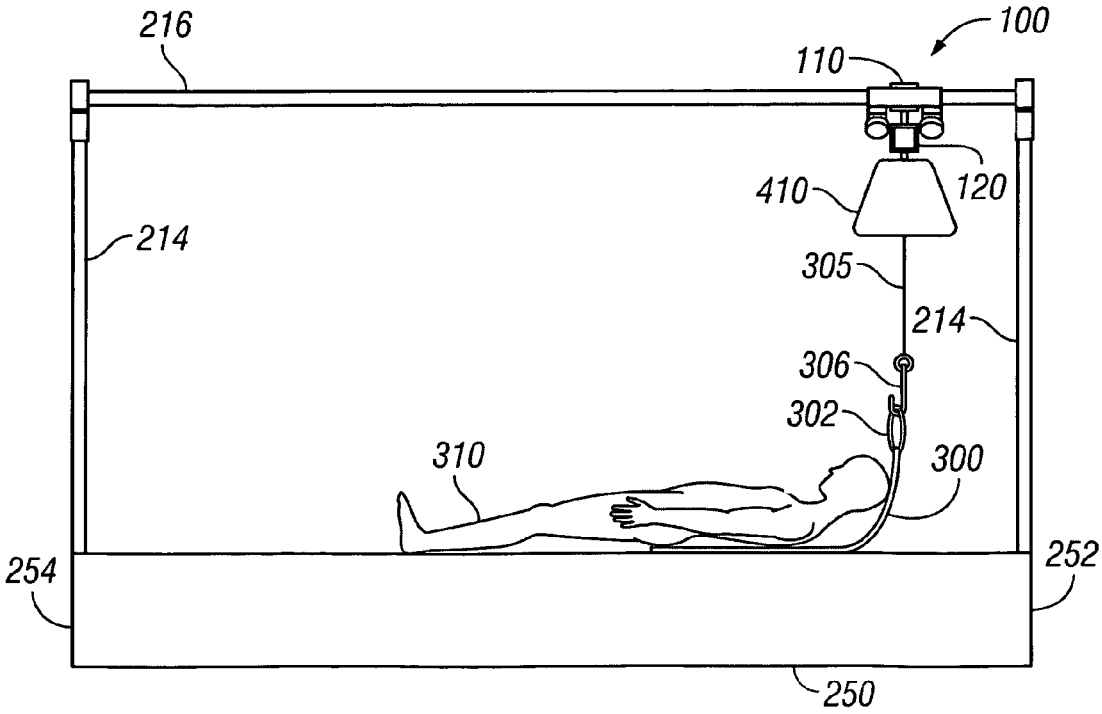
Figure 13:
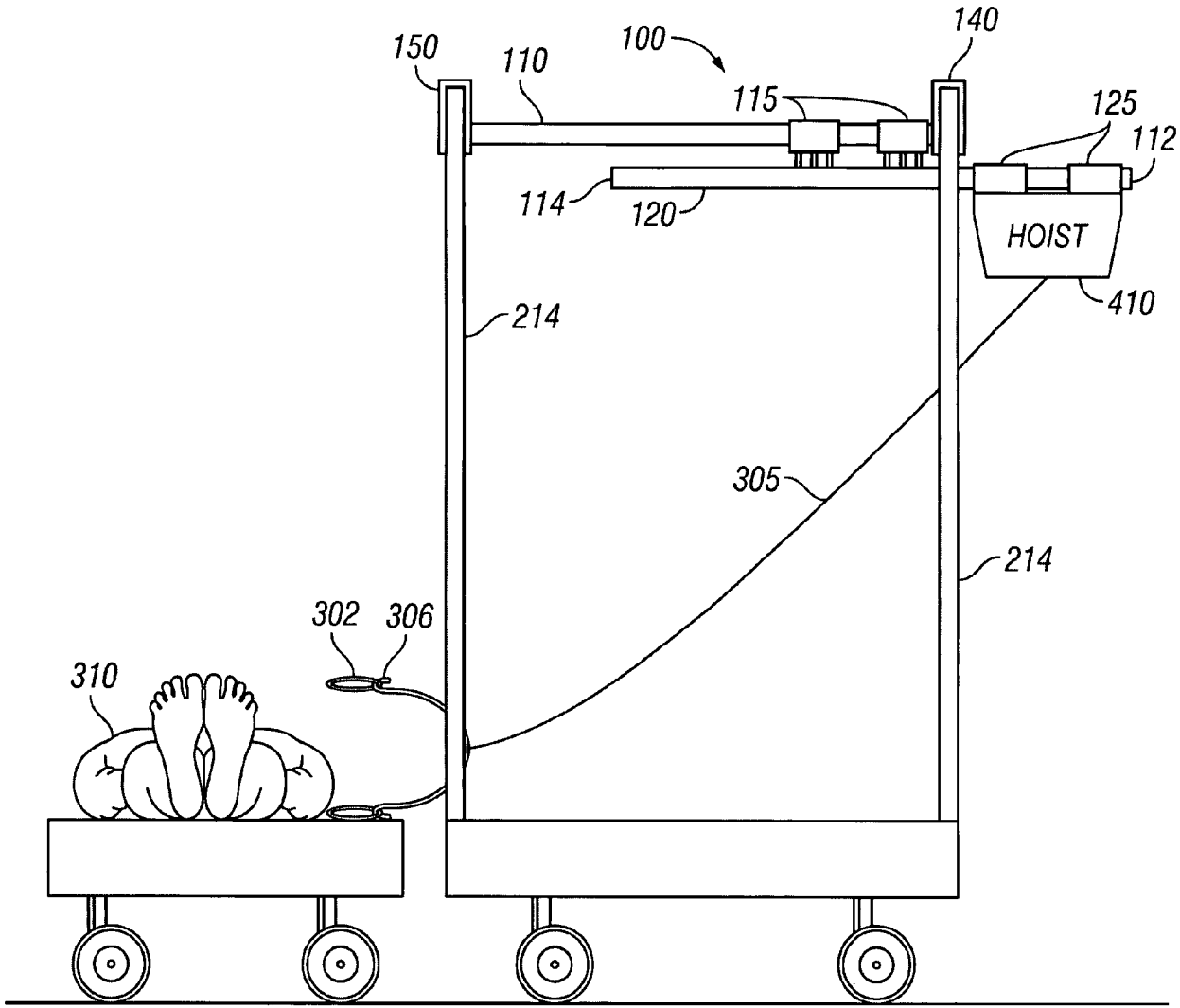
Figure 14:
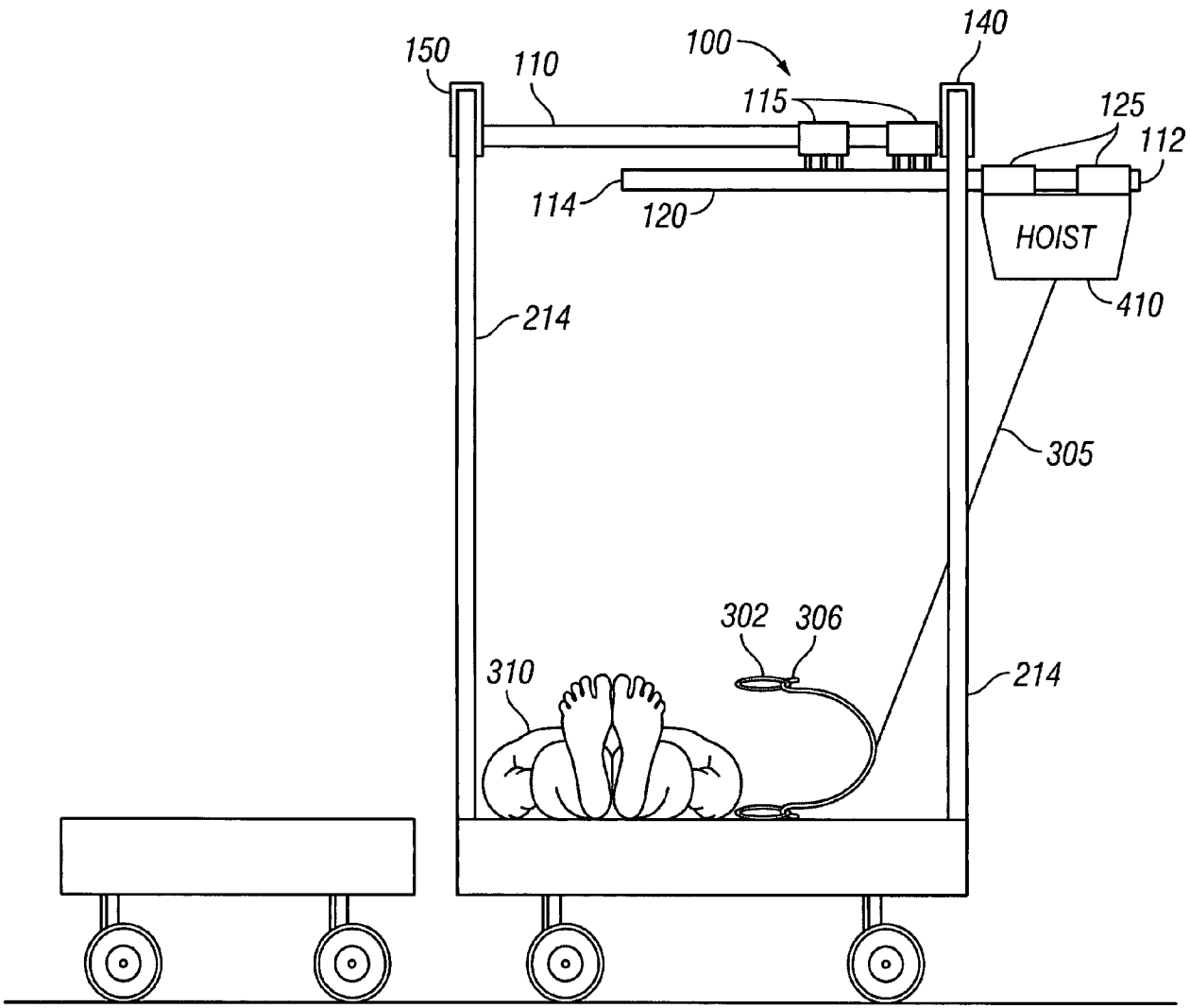
Figure 15:
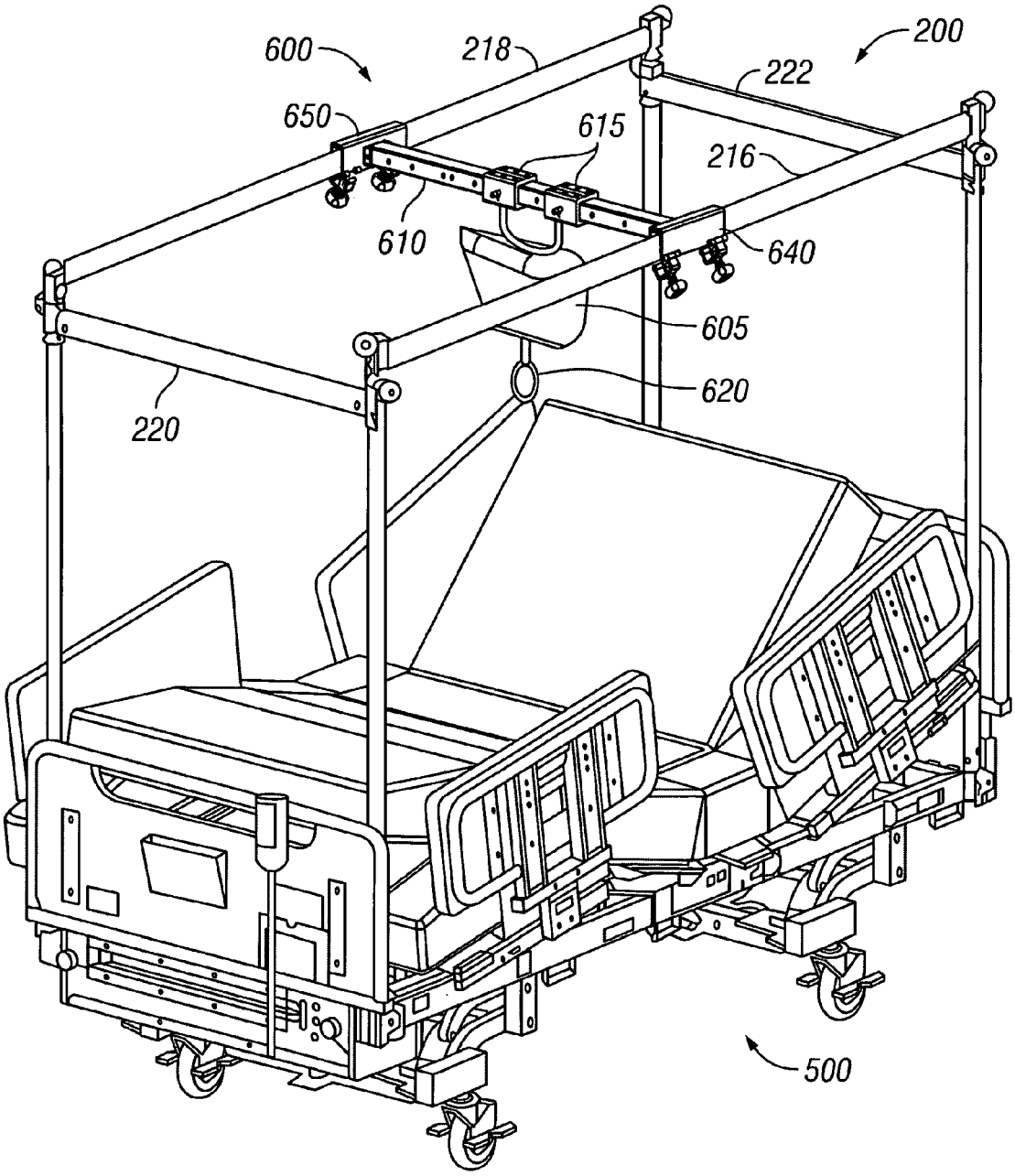
Figure 16:
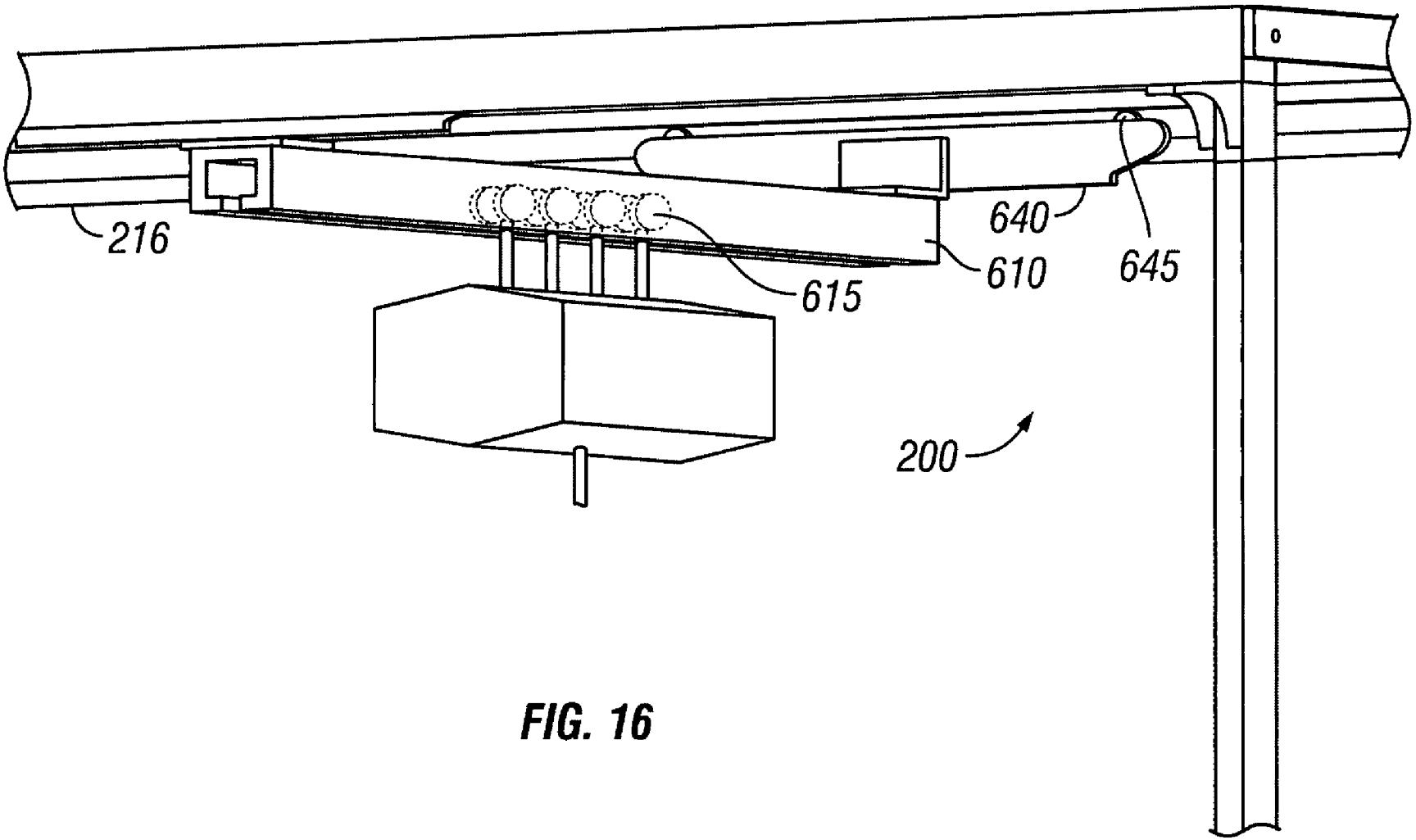
Figure 17:
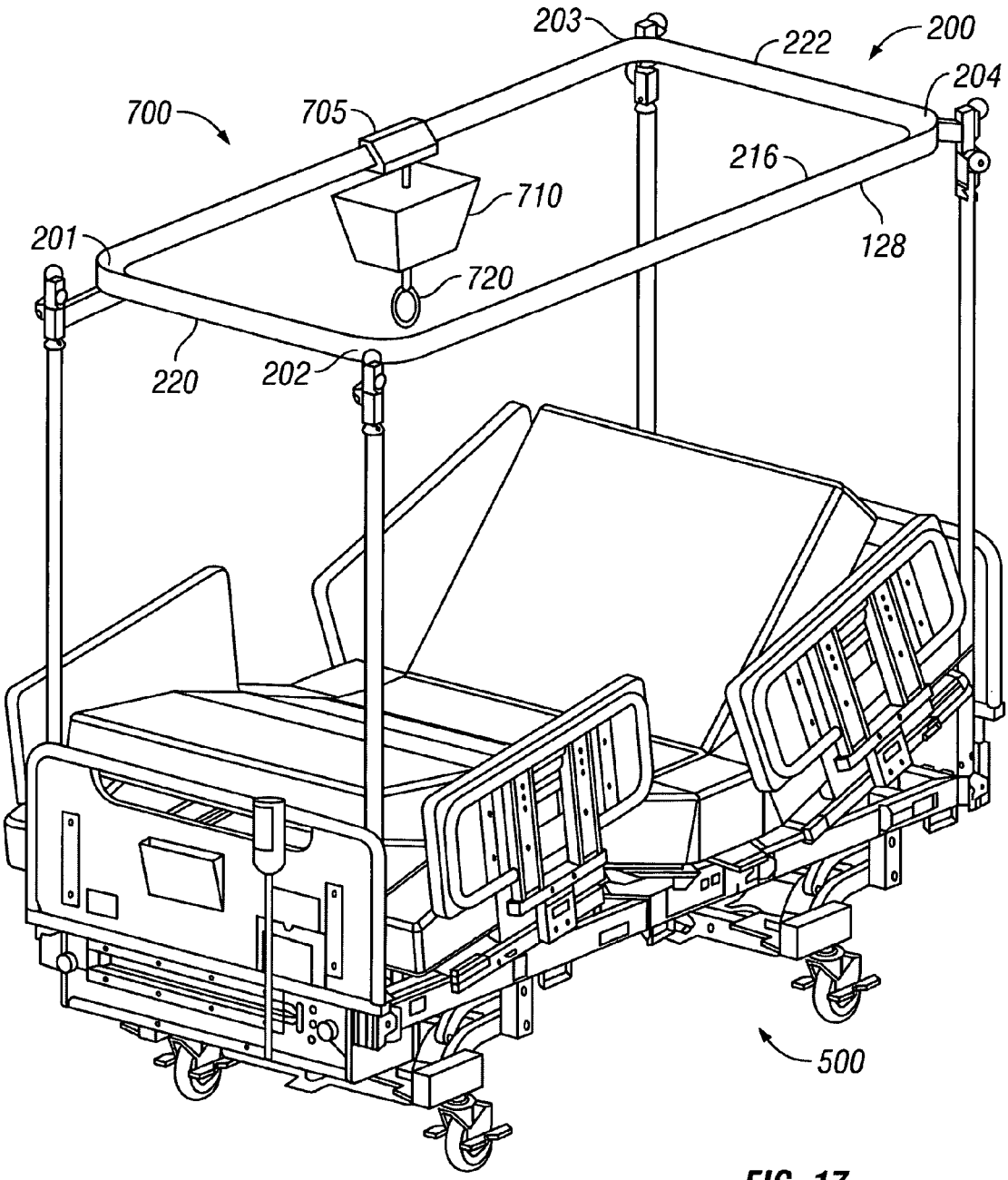

Although the scope of the present invention is much broader than any particular embodiment, a detailed description of the preferred embodiment follows, together with illustrative figures, wherein like reference numerals refer to like components, and wherein:

FIG. 1 illustrates an exploded view of a first exemplary embodiment of a patient repositioning and limb management system;

FIG. 2 illustrates an assembly view of the exemplary embodiment of FIG. 1;

FIG. 3 illustrates a perspective view of the exemplary embodiment of FIG. 1 mounted to a framework;

FIG. 4 illustrates a perspective view of the exemplary embodiment of FIG. 1 in an extended position;

FIG. 5 illustrates a perspective view of the exemplary embodiment of FIG. 1 in an extended position mounted to a framework;

FIG. 6 illustrates a view of a second exemplary embodiment of a patient repositioning system and limb management system;

FIG. 7 illustrates a view of a third exemplary embodiment of a patient repositioning system and limb management system;

FIG. 8 illustrates a view of a fourth exemplary embodiment of a patient repositioning system and limb management system;

FIG. 9 illustrates a view of the exemplary embodiment of FIG. 8 in a retracted position;

FIG. 10 illustrates a view of a fifth exemplary embodiment of a patient repositioning system and limb management system;

FIG. 11 illustrates a view of a sixth exemplary embodiment of a patient repositioning system and limb management system;

FIG. 12 illustrates a view of the exemplary embodiment of FIG. 11 in a retracted position;

FIG. 13 illustrates a view of a seventh exemplary embodiment of a patient repositioning system and limb management system;

FIG. 14 illustrates a view of the exemplary embodiment of FIG. 13 in a retracted position;

FIG. 15 illustrates a view of an eighth exemplary embodiment of a patient repositioning system and limb management system;

FIG. 16 illustrates a detailed view of a portion of the exemplary embodiment of FIG. 15; and FIG. 17 illustrates a view of a ninth exemplary embodiment of a patient repositioning system and limb management system.

DETAILED DESCRIPTION OF EXEMPLARY EMBODIMENTS

Referring now to FIGS. 1-5, one exemplary embodiment of a limb management and patient repositioning (LMPR) system 100 is shown in exploded and assembled views. For purposes of clarity, not all components or features are shown or labeled in each of the figures. In this embodiment, LMPR system 100 comprises an upper transverse support member 110 and a lower transverse support member 120. The embodiment shown comprises a pair of upper transverse slide members 115 engaged in a sliding or translational manner with upper transverse support member 110, and a pair of lower transverse slide members 125 engaged in a sliding or translational manner with lower transverse support member 120. In this embodiment, upper and lower transverse slide members 115 and 125 comprise a pair of low friction inserts 116 and 126 surrounded by casings 117 and 127, respectively. In other embodiments, upper and lower transverse slide members may comprise other components that allow for sliding or translational movement, such as one or more rollers or wheels (not shown).

In the exemplary embodiment of FIGS. 1-5, each pair of upper transverse slide members 115 is coupled to a set of coupling members 119 (which are only partially visible in FIG. 1), which are further coupled to lower transverse support member 120 at holes 121. A linking member 128 is coupled to each casing 127 of lower transverse slide members 125. In this embodiment, a left longitudinal member 140 is coupled to one end of upper transverse support member 110 and a right longitudinal member 150 is coupled to the opposing end of upper transverse support member 110. In the embodiment shown, left and right longitudinal members 140, 150 comprise low friction inserts 141, 151 surrounded by casings 142, 152, respectively. As explained more fully below in the discussion of FIG. 3, left longitudinal member 140 is engaged in a sliding or translational manner with a left longitudinal support member 216, and right longitudinal member 150 is similarly engaged with a right longitudinal support member 218.

As shown in FIG. 1, each casing 127 of lower transverse slide members 125 comprises a slot 129, and each low friction insert 126 comprises a slot 124. When LMPR system 100 is assembled, slots 124 and 129 allow lower transverse slide members 125 to slide past coupling members 119. In the embodiment shown, left and right longitudinal members 140, 150 each comprise a pair of locking members 175 that may be adjusted to prevent LMPR system 100 from sliding along left and right longitudinal members 216 and 218. Locking members 175 may be coupled to left and right longitudinal members 140 and 150 in such a manner to allow LMPR system 100 to be disengaged from a framework or other structural support system (such as framework 200 shown in FIG. 3).

As shown in FIG. 2, upper and lower transverse slide members 115 and 125 are engaged by a pin 170 that is retained with a retaining mechanism 171. Pins 170 engage holes 172 in upper transverse support member 110 and lower transverse support member 120. In this manner, upper and lower transverse slide members 115, 125 can slide along upper and lower transverse support members 110, 120 and then be held in place via the positive engagement of pins 170 and holes 172. While pins with retaining mechanisms have been shown in the exemplary embodiment of FIGS. 1-5, other embodiments may have spring-loaded pins, threaded rods with handles, or other configurations to provide positive engagement for locking purposes. In addition, left and right longitudinal members 216 and 218 may comprise holes and similar locking mechanisms as those of upper and lower transverse slide members 115, 125.

As shown in FIG. 3, LMPR system 100 can be mounted onto a structural support system or framework 200 extending above a support surface or bed 250 comprising a head-end 252, a foot-end 254, a left side 256 and a right side 258. In this exemplary embodiment, framework 200 comprises a set of four vertical members 214 supporting a left longitudinal support member 216, a right longitudinal support member 218, a foot-end transverse member 220 and a head-end transverse member 222. In the exemplary embodiment shown in FIGS. 1-5, left and right longitudinal members 140 and 150 are engaged in a sliding or translational manner with left and right longitudinal members 216 and 218. This allows LMPR system 100 to move between a region near head-end transverse member 222 (and above head-end 252 of bed 250) and a region near foot-end transverse member 220 (and above foot-end 254 of bed 250). In addition, upper transverse slide members 115 may slide on upper transverse support member 110 and lower transverse slide member 125 may slide on lower transverse support member 120. As a result, LMPR system 100 can be manipulated or positioned so that a portion of lower transverse support member 120 extends past left longitudinal support member 216 or right longitudinal support member 218. For example, if upper transverse slide members 115 are positioned near left longitudinal member 140 and lower transverse slide members 125 are positioned near end 114 of lower transverse support member 120, then end 114 of lower transverse support member 120 will extend beyond left longitudinal member 140. Such a configuration allows lower transverse slide members 125 and linking member 128 to extend beyond left longitudinal member 140. Therefore, when LMPR system 100 is engaged with framework 200, end 114 and linking member 128 may be positioned to extend beyond left longitudinal support member 216.

Similarly, if upper transverse slide members 115 are positioned near right longitudinal member 150 and lower transverse slide members 125 are positioned near end 112 of lower transverse support member 120, then end 112 of lower support member transverse will extend beyond right longitudinal member 150 (as shown in FIG. 4). Such a configuration allows lower transverse slide members 125 and linking member 128 to extend beyond right longitudinal member 150. Therefore, when LMPR system 100 is engaged with framework 200, end 112 and link 128 may be positioned to extend beyond right longitudinal support member 218, as shown in FIG. 5.

The configuration of LMPR system 100 and framework 200 allows linking member 128 to be placed in a multitude of locations from regions above head-end 252 to regions above foot-end 254 of bed 250. The configuration also allows linking member 128 to be placed in a multitude of locations from regions above and to the left of left side 256 and to regions above and to the right of right side 258. Additional components may also be coupled to linking member 128 to assist a patient or other person supported by bed 250 or other support surface.

Referring now to FIG. 6, for example, a lifting system 400 comprising a hoist 410 and a strap or sling 420 may be coupled to linking member 128 or lower transverse slide members 125. In the exemplary embodiment shown in FIG. 6, LMPR system 100 is coupled to framework 200, which extends above a therapeutic bed 500. In this exemplary embodiment, LMPR system 100 can be manipulated in the manner described above to place link 128 and lifting system 400 in a desirable location. Hoist 410 can then be operated to lower sling 420 towards therapeutic bed 500, so that sling 420 can be used to engage a person supported by therapeutic bed 500. For example, sling 420 can be placed around a person's leg or arm, and hoist 410 used to raise sling 420 so that the person's arm or leg are supported by sling 420. In certain exemplary embodiments, hoist 410 is configured to lift 600 pounds. In other exemplary embodiments, hoist 410 may be configured to lift greater amounts, including 700, 800, 900, 1000 pounds or more.

In other exemplary embodiments, different components may be coupled to linking member 128 or lower transverse slide members 125 or sling 420. For example, referring now to FIG. 7, a handle 130 may be coupled to linking member 128 via a coupling member such as a chain 131 or hoist (not shown). In this exemplary embodiment, LMPR system 100 can be positioned as previously described so that linking member 128 and handle 130 are located in a desired location. In certain exemplary embodiments, either upper or lower transverse slide members 115, 125 may be permitted to slide along upper or lower transverse support member 110, 120. In such exemplary embodiments, a person may grasp handle 130 and continue to grasp it during ingress or egress from bed 250. Transverse slide members 115 and 125 can slide along upper transverse support member 110 and lower transverse support member 120, thereby allowing handle 130 to slide from a region located directly above bed 250 to a region above and next to bed 250.

Referring now to FIGS. 8 and 9, a roll sheet or a repositioning sheet 300 may be coupled to hoist 410 via a strap 305. As shown in FIG. 8, repositioning sheet 300 may be placed under a patient 310 while strap 305 is extended from hoist 410, which is positioned above and to the side of patient 310. As shown in FIG. 9, hoist 410 can be operated to retract strap 305 and raise a portion of repositioning sheet 300. In this exemplary embodiment, patient 310 can be rolled or repositioned to allow care for the patients' back. Hoist 410 can then be operated to extend strap 305 and allow patient 310 to return to the position shown in FIG. 8.

Referring now to FIG. 10, in one exemplary embodiment, hoist 410 is coupled to a spreader bar 306 via strap 305. In this exemplary embodiment, repositioning sheet 300 comprises straps or loops 302 which are coupled to spreader bar 306. In certain exemplary embodiments, repositioning sheet may be configured similar to the repositioning system disclosed in U.S. patent application Ser. No. 11/972,364 filed on Jan. 10, 2008, which is incorporated herein by reference.

Referring now to FIG. 11, a side view is shown of a patient 310 who has migrated towards foot-end 254 of bed 250. In this exemplary embodiment, repositioning sheet 300 has been placed under patient 310 and loops 302 coupled to spreader bar 306, which is coupled to hoist 410 via strap 305. As shown in the exemplary embodiment of FIG. 12, hoist may be operated to retract strap 305, which pulls spreader bar 306, repositioning sheet 300, and patient 310 towards head-end 252 of bed 250. In this manner, hoist 410 and LMPR system 100 may assist a caregiver in relocating patient 310 within bed 250.

Referring now to FIGS. 13 and 14, in another exemplary embodiment, LMPR system 100 may assist a caregiver in transporting a patient from one surface to another surface. In the exemplary embodiment shown, patient 310 is initially located on a support surface 251. Repositioning sheet 300 is placed under patient 310, and loops 302 are coupled to spreader bar 306, which is coupled to hoist 410 via strap 305 in this exemplary embodiment. As shown in FIG. 12, hoist 410 can be operated to retract strap 305, which pulls spreader bar 306, repositioning sheet 300, and patient 310 towards bed 250. In this manner, hoist 410 and LMPR system 100 may assist a caregiver in transferring patient 310 from support surface 251 to bed 250.

Exemplary embodiments shown and described in this disclosure provide numerous benefits. For example, LMPR system 100 and framework 200 provide a system that allow for hoist 410 to be conveniently located and accessed by an operator. In certain exemplary embodiments, LMPR system 100 and framework 200 are associated with a specific bed or other support surface. In such exemplary embodiments, an operator does not have to locate and transport a hoist to a bed for a patient. In addition, LMPR system 100 does not require a fixed overhead system (such as ceiling mounted tracks) to provide a support for hoist 410.

In certain exemplary embodiments, slide surfaces such as upper and lower transverse support members 110, 120 and left and right longitudinal support members 216, 218 are comprised of low friction material such as powder-coated steel or aluminum or hard anodized aluminum. When engaged with low friction inserts 116 and 126, the amount of forced required to position LMPR system 100 is reduced. In certain exemplary embodiments, low friction inserts 116, 126, 141, and 151 may be comprised of friction-reducing plastic such as PTFE, acetal resin (i.e., Delrin® from E.I. DuPont de Nemours and Company) or oil-impregnated resin.

Referring now to FIG. 15, another exemplary embodiment comprises a LMPR system 600 with a single transverse support member 610 coupled to left longitudinal member 640 and right longitudinal member 650. LMPR 600 also comprises a hoist 605 with a strap or sling 620 coupled to transverse support member 610. In this embodiment, hoist 605 is coupled to transverse support member 610 via a pair of rollers 615. Rollers 615 comprise rolling elements such as bearings or wheels. Rollers 615 are not visible within the outer housings of rollers 615 shown in FIG. 15. Rollers 615 are visible in the detailed view shown in FIG. 16, in which the outer housings are not shown. Also visible in FIG. 16 are rollers 645, which are coupled to left longitudinal member 640 and engaged with longitudinal support member 216.

Rollers 615 allow hoist 605 to translate with respect to transverse support member 610 so that hoist 605 may travel between left longitudinal member 640 and right longitudinal member 650. In other exemplary embodiments, hoist 605 may be coupled to transverse support member 610 with other devices that allow hoist 605 to slide or translate with respect to transverse support member 610. In addition, left longitudinal member 640 and right longitudinal member 650 may translate along left and right longitudinal support members 216 and 218 so that LMPR system 600 may be moved toward or away from head-end transverse member 222 and foot-end transverse member 220.

Referring now to FIG. 17, another exemplary embodiment comprises a LMPR system 700 that includes a coupling member 705 that couples a hoist 710 to framework 200. In this exemplary embodiment, framework 200 comprises a series of curved portions 201, 202, 203, and 204 between head-end transverse member 222, right longitudinal support member 218, foot-end transverse member 220, and left longitudinal support member 216. Framework 200 therefore comprises a path around the area above therapeutic bed 500 that allows LMPR system 700 to move between head-end transverse member 222, right longitudinal support member 218, foot-end transverse member 220, left longitudinal support member 216, and back to head-end transverse member 222, without being decoupled from the framework 200. This allows LMPR system 700 to be moved around the perimeter of framework 200 to one of multiple locations while being supported by framework 200.

Hoist 710 may also comprise a handle, loop, or strap 720 to allow a patient to hold onto or to connect another piece of equipment (for example, a spreader bar and repositioning sheet or other device needed to reposition a patient). Coupling member 705 may comprise low friction inserts or rolling elements (not shown) that reduce the amount of effort required to move coupling member 705 around framework 200. Coupling member 705 may also comprise locking members (not shown) that allow LMPR system 700 to be held in place when it is placed in the desired location within framework 200.

While certain exemplary embodiments of the present invention have been shown and described in detail above, it will be clear to the person skilled in the art that changes and modifications may be made without departing from the scope of the invention. The actual scope of the invention is intended to be defined by the following claims, along with the full range of equivalents to which such claims are entitled.

The invention claimed is:

1. A system for repositioning a person, the system comprising:

a bed framework comprising a first longitudinal support member, a second longitudinal support member, a head-end transverse member, and a foot-end transverse member;

a first transverse support member;

a second transverse support member coupled to the first transverse support member, wherein the second transverse support member is configured to translate with respect to the first transverse support member;

a first longitudinal member coupled to a first end of the first transverse support member; and a second longitudinal member coupled to a second end of the first transverse support member, wherein:

the first and second longitudinal members are slidably engaged with the first and the second longitudinal support members, respectively;

the first and second longitudinal members and the first and second transverse support members can be moved from a region proximal to the head-end transverse member to a region proximal to the foot-end transverse member; and a first end of the second transverse support member is configured to extend beyond the first longitudinal member when the system is in a first position, and wherein a second end of the second transverse support member is configured to extend beyond the second longitudinal member when the system is in a second position.

2. The system of claim 1, further comprising a first locking member configured to secure the second transverse support member so that the second transverse support member is restricted from translating with respect to the first transverse support member.

3. The system of claim 2, further comprising a second locking member configured to secure the first or second longitudinal member so that the first and second longitudinal members are restricted from moving with respect to the first and second longitudinal support members during use.

4. The system of claim 1, further comprising a structural support system that extends above a bed or other support surface comprising a head-end, a foot-end, a right side and a left side.

5. The system of claim 4 wherein the system is configured to be positioned in one of multiple locations between the head-end, the foot-end, the right side, and the left side.

6. The system of claim 1, further comprising a handle coupled to either the first or second transverse support members.

7. The system of claim 1, further comprising a hoist coupled to either the first or second transverse support members.

8. The system of claim 7, further comprising a sling coupled to the hoist.

9. The system of claim 7, further comprising a repositioning sheet coupled to the hoist via a spreader bar.

10. The system of claim 1 wherein the first and second transverse support members are comprised of at least one of powder-coated steel, powder-coated aluminum, and hard anodized aluminum.

11. The system of claim 1 wherein the first and second longitudinal members each comprise a low friction insert.

12. The system of claim 1, further comprising a first slide member, wherein the first slide member is coupled to the first transverse support member in a translational engagement and the first slide member is coupled to the second transverse support member in a non-translational engagement.

13. The system of claim 12, further comprising a second slide member coupled to the second transverse support member in a translational engagement.

14. The system of claim 13, further comprising a coupling member coupling the first slide member to the second transverse support member, wherein the second slide member is configured to translate past the coupling member.

15. A system for repositioning a person, the system comprising:

a bed;

a framework coupled to the bed and extending above the bed, wherein the framework comprises a first longitudinal support member and a second longitudinal support member and a head-end transverse member and a foot-end transverse member;

a first transverse support member comprising a first end and a second end;

a first longitudinal member coupled to the first end of the first transverse support member;

a second longitudinal member coupled to the second end of the first transverse support member;

a second transverse support member coupled to the first transverse support member, wherein the second transverse support member is configured to translate with respect to the first transverse support member; and a lifting apparatus coupled to the transverse support member, wherein the lifting apparatus is configured to be moved between the first end and the second end of the first transverse support member wherein:

the first and second longitudinal members are slidably engaged with the first and the second longitudinal support members, respectively;

the first and second longitudinal members and the first and second transverse support members can be moved from a region proximal to the head-end transverse member to a region proximal to the foot-end transverse member; and a first end of the second transverse support member is configured to extend beyond the first longitudinal member when the system is in a first position, and wherein a second end of the second transverse support member is configured to extend beyond the second longitudinal member when the system is in a second position.

16. The system of claim 15 wherein the lifting apparatus is a hoist.

17. The system of claim 15 wherein the lifting apparatus comprises a rolling element that engages the transverse support member.

18. A system for repositioning a person, the system comprising:

a bed;

a framework coupled to the bed and extending above the bed, wherein the framework comprises a first longitudinal support member, a second longitudinal support member, a head-end transverse member and a foot-end transverse member; and a lifting apparatus coupled to the framework, wherein the lifting apparatus is configured to be moved between the head-end transverse member, the first longitudinal support member, the foot-end transverse member, the second longitudinal support member, and back to the head-end transverse member without being decoupled from the framework; wherein the framework further comprises a plurality of curved portions between the head-end transverse member, the first longitudinal support member, the foot-end transverse member, and the second longitudinal support member.

19. The system of claim 18 wherein the lifting apparatus is a hoist.

* * * * *